US005839146A

United States Patent [19]

Chen

[11] Patent Number: 5,839,146

[45] Date of Patent: Nov. 24, 1998

[54] BACK CLEANING BRUSH

[76] Inventor: Kuo-Chin Chen, 2-1 Fl., No. 18, Alley 47, Lane 208, Jui An Street, Ta An District, Taipei, Taiwan

[21] Appl. No.: 992,207

[22] Filed: Dec. 17, 1997

[51] Int. Cl.[6] ..... A47K 7/02; A46B 3/18

[52] U.S. Cl. ..... 15/114; 15/118; 15/206; 15/222

[58] Field of Search ..... 15/104.165, 104.2, 15/114, 118, 164, 160, 206, 211, 222

[56] References Cited

U.S. PATENT DOCUMENTS

| | | | |
|---|---|---|---|
| 1,890,894 | 12/1932 | Arnold et al. | 15/118 X |
| 2,303,660 | 12/1942 | Schickel | 15/206 X |
| 3,268,938 | 8/1966 | Smith | 15/222 X |
| 3,409,926 | 11/1968 | Martin | 15/114 |
| 4,114,504 | 9/1978 | Koregelos | 15/206 X |
| 5,491,863 | 2/1996 | Dunn | 15/114 X |

FOREIGN PATENT DOCUMENTS

| | | | |
|---|---|---|---|
| 528464 | 6/1954 | Belgium | 15/114 |
| 454114 | 9/1936 | United Kingdom | 15/206 |

*Primary Examiner*—Mark Spisich
*Attorney, Agent, or Firm*—Pro-Techtor International Services

[57] ABSTRACT

A back cleaning brush mainly including two steel wires and a large number of mixed brush hairs, foam rubber strips and/or scouring pads positioned between the two steel wires. The steel wires are spirally twisted together to tightly clamp the brush hairs, the foam rubber strips and/or the scouring pads in place, so that two ends of the brush hairs, the foam rubber strips, and/or the scouring pads evenly and radially extend outward from the twisted steel wires. The foam rubber strips and the scouring pads have good water absorbing ability to hold sufficient amount of water and soap bubbles when the back cleaning brush is wetted to clean user's back.

3 Claims, 3 Drawing Sheets

BACK CLEANING BRUSH

BACKGROUND OF THE INVENTION

The present invention relates to a back cleaning brush, and more particularly to a back cleaning brush which absorbs sufficient water and soap bubbles to facilitate cleaning of a user's back.

There are many kinds of back brushes available in the market. Among these back brushes, there is a brush formed from fine thread-like material, such as loofah, nylon hairs and animal hairs. FIG. 1 illustrates a conventional back brush containing such fine hairs. As shown, these fine hairs 2 have substantially similar length and are positioned between two steel wires 1. The steel wires 1 are spirally twisted to tightly and fixedly clamp the fine hairs 2 between them while cause two ends of the hairs 2 to evenly and radially extend from the twisted steel wires 1. Two outer ends of the twisted steel wires 1 are bare without hairs 2, so that these bare ends can be associated with suitable means to serve as grip portions 3. Whereby, a user may hold the back cleaning brush at the grip portions 3 to clean his or her back when taking a bath by scrubbing the fine hairs against his or her back. These brush hairs made of dried plant fibers, nylon hairs or animal hairs are not water-absorbent materials. The back brush containing such brush hairs can only scrub the user's back without holding adequate amount of water and soap or bathing milk bubbles among the brush hairs, and is therefore, less useful in terms of cleaning the user's back. It is therefore tried by the inventor to develop a back cleaning brush to eliminate the above-mentioned drawback existing in the conventional back cleaning brushes.

SUMMARY OF THE INVENTION

A primary object of the present invention is to provide a back cleaning brush which includes water-absorbent and bubble-holding brush hairs to effect thorough cleaning.

To achieve the above and other objects, there is provided a back cleaning brush including two steel wires and a large number of equal-length brush hairs positioned between the two steel wires. The steel wires are spirally twisted to tightly and fixedly clamp the brush hairs in place between the wires while allowing two ends of the brush hairs to evenly and radially extend outward from the twisted steel wires. The brush hairs includes, in addition to general brush hairs, foam rubber and/or scouring pad in suitable forms. Since the foam rubber and the scouring pad both have very good water absorbing ability, the back cleaning brush containing these materials as the brush hairs may hold sufficient amount of water and soap bubbles to thoroughly clean a user's skin.

BRIEF DESCRIPTION OF THE DRAWINGS

The objects, the features, and the function of the present invention can be best understood by referring to the following detailed description of the preferred embodiments and the accompanying drawings, wherein.

DETAILED DESCRIPTION OF THE PREFERRED EMBODIMENTS

Figure 1:
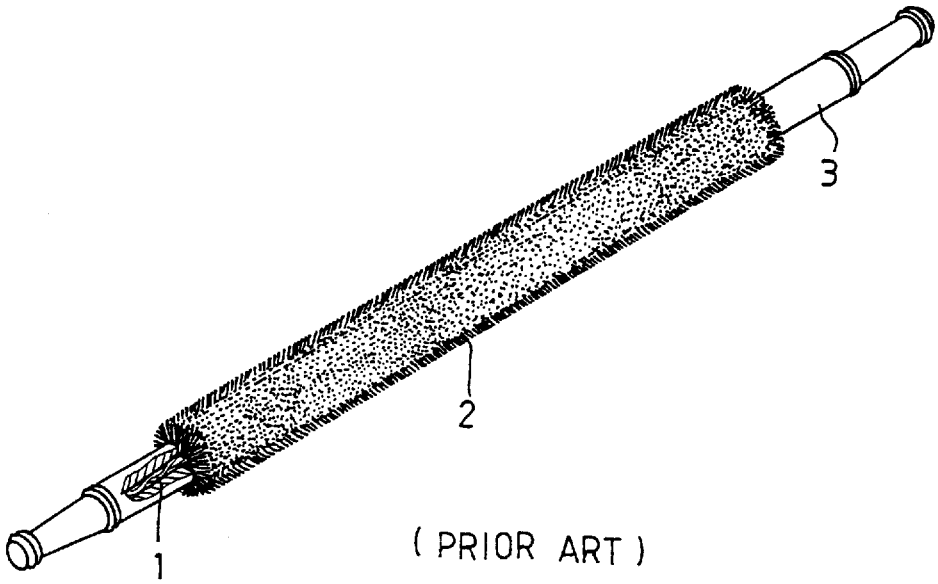
( PRIOR ART ) FIG.1
FIG. 1 is a perspective of a conventional back cleaning brush with fine brush hairs.
Figure 2:
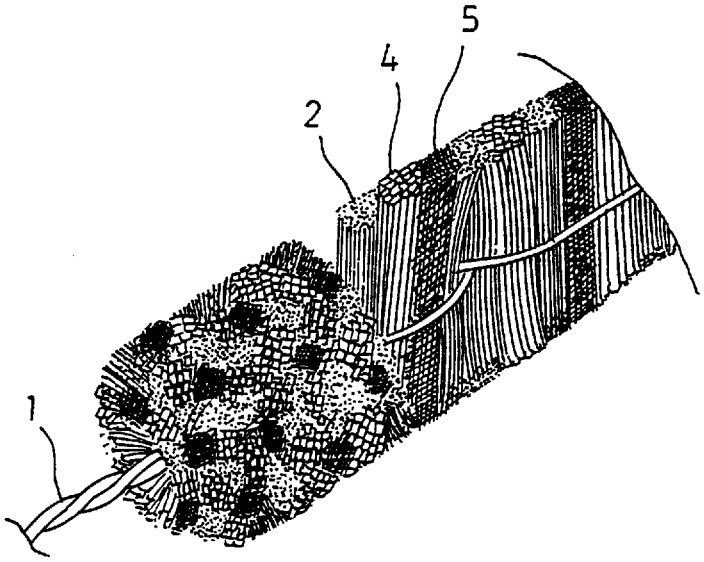
FIG. 2 is a perspective showing the manner in which a preferred embodiment of the back cleaning brush according to the present invention is formed.

Please refer to FIG. 2 in which a partially completed back cleaning brush according to a preferred embodiment of the present invention is shown. The brush includes two steel wires 1 and a large number of equal length general brush hairs 2, foam rubber strips 4, and scouring pads 5 positioned between the two steel wires 1. The steel wires 1 are spirally twisted, so that the brush hairs 2, the foam rubber strips 4, and the scouring pads 5 are tightly fixed in place by the twisted steel wires 1 with their two ends evenly and radially extending outward from the twisted wires 1. The foam rubber strips 4 and the scouring pads 5 are structurally water absorbent, allowing the back cleaning brush of the present invention, when being wetted, to hold adequate amount of water and soap bubbles to thoroughly clean the user's skin.

Figure 3:
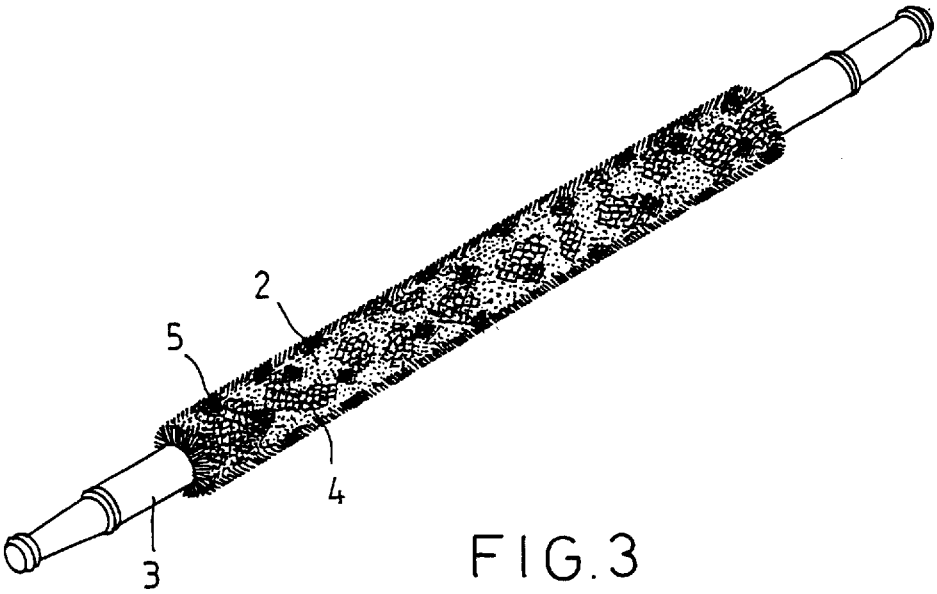
FIG. 3 is a perspective of a back cleaning brush formed from FIG. 2 in a straight form.
Figure 4:
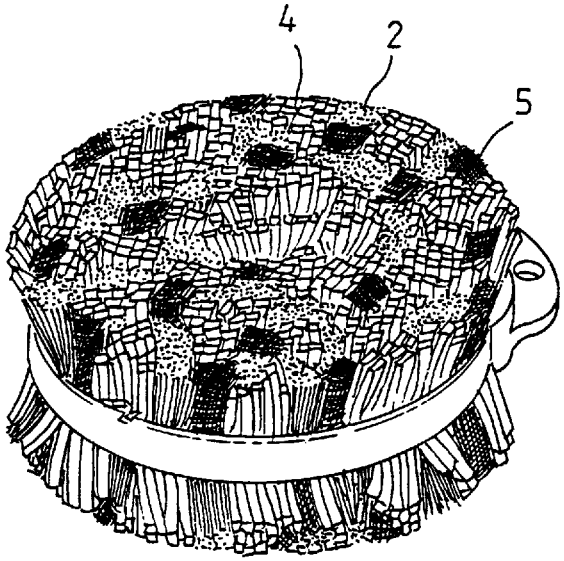
FIG. 4 is a perspective showing the back cleaning brush formed from FIG. 2 in a wound form.

The twisted steel wires 1 with the brush hairs 2, the foam rubber strips 4 and the scouring pads 5 clamped therebetween can be used to form differently shaped brushes. FIG. 3 illustrates a straight bar-like brush with two grips mounted to two outer ends for convenient holding of the brush. In FIG. 4, the brush hairs 2, the foam rubber strips 4, and the scouring pads 5 are provided along full length of the two twisted steel wires 1, and the steel wires 1 are wound into a round plate with two ends of the wires 1 fixed in place, forming a flat and round back cleaning brush.

Figure 5:
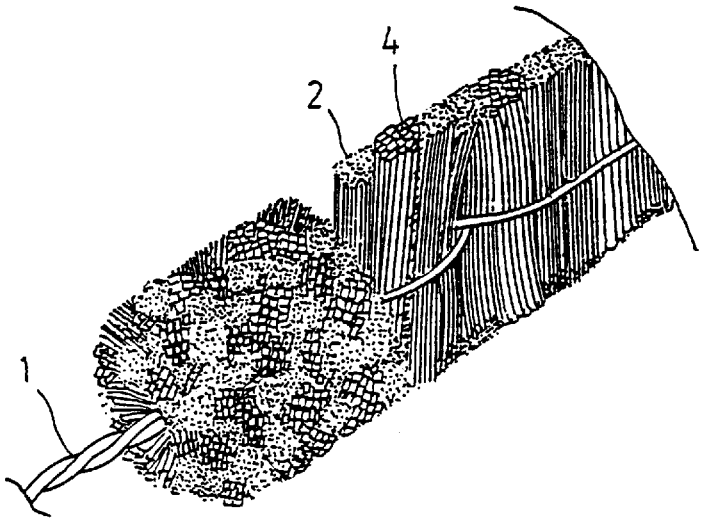
FIG. 5 is another embodiment of the present invention.

In another embodiment of the present invention, the steel wires 1 of the brush may also clamp only general brush hairs 2 and the foam rubber strips 4, as shown in FIG. 5. Since the foam rubber strips 4 are good water absorbent material, the brush in this embodiment may still hold adequate amount of water and soap bubbles to effect a thorough cleaning on the user's skin.

Figure 6:
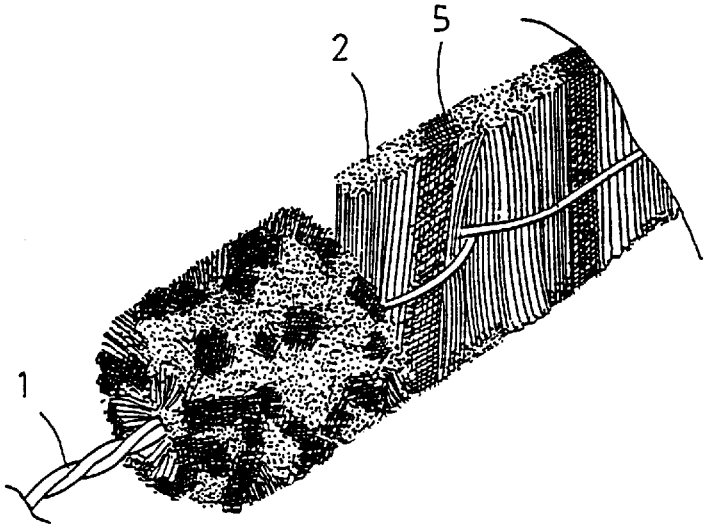
FIG. 6 is a further embodiment of the present invention.

In a further embodiment of the present invention, the steel wires 1 of the brush clamp only general brush hairs 2 and the scouring pads 5, as shown in FIG. 6. Since the scouring pads 5 also have good water absorbing ability, the brush in this third embodiment may still hold adequate amount of water and soap bubbles to effect a thorough cleaning on the user's skin.

What is claimed is:

1. A back cleaning brush comprising two steel wires and a large number of equal-length general brush hairs and equal-length absorbent foam rubber strips positioned between said two steel wires, the length of said foam rubber strips being substantially equal to that of said brush hairs; said two steel wires being spirally twisted together, causing said brush hairs and, said foam rubber strips to be tightly and fixedly clamped in place between said two twisted steel wires with said foam strips dispersed among the brush hairs along the length of said steel wires with two ends of said brush hairs and said foam rubber strips evenly and radially extending outward from said twist steel wires.

2. A back cleaning brush as claimed in claim 1, wherein a large number of scouring pads are also positioned and clamped between said two steel wires.

3. A back cleaning brush comprising two steel wires and a large number of equal-length general brush hairs and equal-length scouring pads positioned between said two steel wires, the length of said scouring pads being substantially equal to that of said brush hairs; said two steel wires being spirally twisted together, causing said brush hairs and said scouring pads to be tightly and fixedly clamped in place between said two twisted steel wires with said scouring pads dispersed among the brush hairs along the length of said steel wires with two ends of said brush hairs and said scouring pads evenly and radially extending outward from said twist steel wires.

* * * * *